United States Patent [19]

Mikhail

[11] Patent Number: 4,836,366

[45] **Date of Patent: * Jun. 6, 1989**

[54] CIGARETTE PACKS AND BOXES WITH ATTACHED MATCHES

[76] Inventor: Ameer G. Mikhail, 945 Riverside Dr., Unit #15-A, Methuen, Mass. 01844

[ * ] Notice: The portion of the term of this patent subsequent to May 25, 2003 has been disclaimed.

[21] Appl. No.: 429,790

[22] Filed: Sep. 30, 1982

[51] Int. Cl.[4] ..... B65D 85/10

[52] U.S. Cl. ..... 206/94

[58] Field of Search ..... 206/94

[56] References Cited

U.S. PATENT DOCUMENTS

| | | | |
|---|---|---|---|
| 1,606,469 | 11/1926 | Folz | 206/94 |
| 1,720,589 | 7/1929 | Danab | 206/94 |
| 1,976,189 | 10/1934 | Pauli | 206/94 |
| 2,323,342 | 7/1943 | McManus et al. | 206/94 |
| 2,547,620 | 4/1951 | Capano | 206/94 |
| 2,634,854 | 4/1953 | Brandt et al. | 206/94 |
| 2,802,566 | 8/1957 | Winstanley Jr. | 206/94 |
| 2,805,183 | 9/1957 | Higgins | 206/94 |
| 2,975,890 | 3/1961 | Block | 206/94 |
| 3,509,989 | 5/1970 | Woll | 206/94 |
| 4,355,716 | 10/1982 | Berrio de la Fe | 206/94 |

*Primary Examiner*—Joseph Man-Fu Moy

[57] ABSTRACT

Cigarette boxes and packs with attached match books are introduced to enhance the convenience of having matches very close to cigarettes where they are needed. Common and ordinary match books are attached to hard-top box or soft pack cigarette package through a strip of paper or cardboard which is wrapped around the cigarette pack. the match book can be inserted and removed from the strip at will and can then be reinserted or removed again. Additional spots of abraisive material are located on the paper strip to allow the use of matches while the match book is still attached to the cigarette pack through the strip.

1 Claim, 1 Drawing Sheet

CIGARETTE PACKS AND BOXES WITH ATTACHED MATCHES

BACKGROUND OF THE INVENTION

The art of combining cigarette packs and matches is known to exist for a considerable time. The main objective in these inventions, as well as in the present invention, is to facilitate the availability of the matches near the cigarette box where they are needed. Most of these inventions involve complex or elaborate designs that render them being either costly to manufacture or impractical to use. In modern days, cost and practicality are the main important considerations for marketing and usefullness. Cigarette packing firms will not be willing to retool to produce a new package, if cost and practicality do not warrent that. Also to request a modified match-book with special features will not be welcome by the match-book industry.

The present invention utilizes the currently available two components: the cigarette pack (in its hard box or soft pack forms) and the ordinary and common match-book. Thus, this invention will be readily acceptable in the market place by the manufacturers and the users. In addition, this invention allows the removal and re-insertion of the match-book to the cigarette package, at will and without removing or destroying the paper strip.

This invention is also considered for its advertising potential. The strip which holds the pack and matches together can be overprinted with advertising material for different brands of products. The match-book may also be printed with the same advertisment. With millions of smokers accross the country and the world, this combination package has great market potential and improves the art of its field. This invention will also reduce the need for cigarette lighters, since each new package comes with its accompanying match-book.

REFRENCES TO THE PRIOR ART

| U.S. Pat. Documents | | | Class/Subclass |
|---|---|---|---|
| 1,606,469 | 11/1926 | Folz | 206/94 |
| 1,720,589 | 7/1929 | Danab | 206/94 |
| 1,976,189 | 10/1934 | Pauli | 206/94 |
| 2,323,342 | 7/1943 | McManus et al | 206/94 |
| 2,547,620 | 4/1951 | Capano | 206/94 |
| 2,634,854 | 4/1953 | Brandt et al | 206/94 |
| 2,802,566 | 8/1957 | Winstanley, Jr | 206/94 |

-continued

| U.S. Pat. Documents | | | Class/Subclass |
|---|---|---|---|
| 2,805,183 | 9/1957 | Higgins | 206/94 |
| 2,975,890 | 3/1961 | Block | 206/94 |
| 3,509,989 | 5/1970 | Woll | 206/94 |
| 4,355,716 | 10/1982 | Berrio de la Fe | 206/94 |

DESCRIPTION OF THE PREFERED EMBODIMENT

Figure 1:
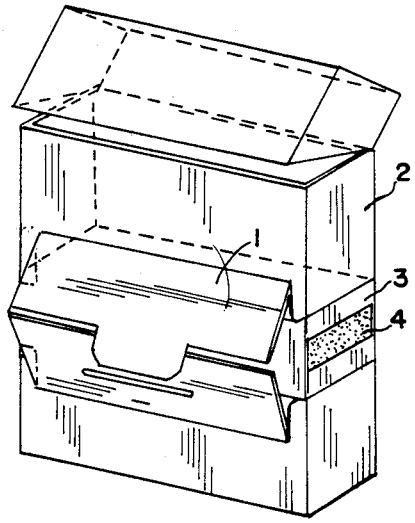
FIG. 1. Isometric for the hard-top cigarette box with the attached match-book.
Figure 2:
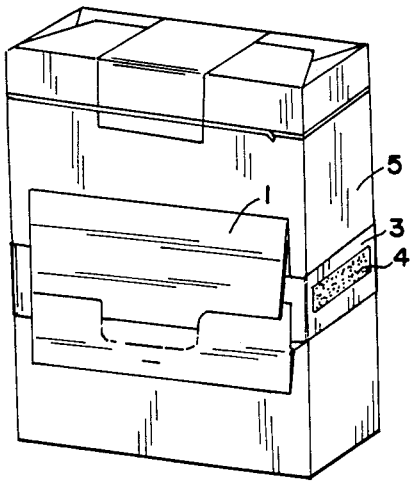
FIG. 2. Isometric for the soft cigarette pack with the attached match-book.
Figure 3:
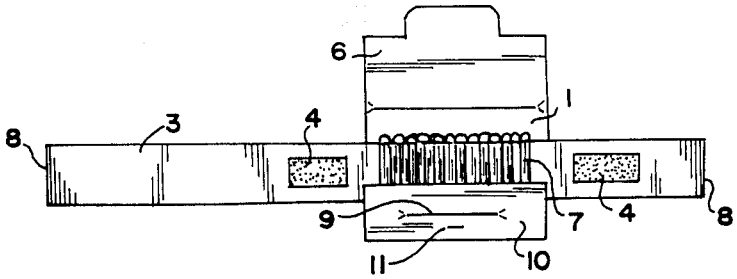
FIG. 3. Detail for the paper strip/match-book assembly.

An ordinary match book 1 is combined with a cigarette hard-top cigarette box as shown in FIG. 1 (or with a soft pack as shown in FIG. 2) through a strip 3 made of paper or any other thin material. The strip of paper is placed between the match-book cover 6 and the match stems 7, as shown in FIG. 3. The strip 3 has at least one spot 4 of abraisive material—preferably in a geometric shape—on one of its surfaces, for use as a striking surface for the matches. This added abraisive surface is needed in conjunction with the ordinary match-book which has its striking surface on the back side. Thus one needs either to remove the match-book from the strip, or to modify the match-book to have the striking surface on the front side. The addding of the abraisive material spot alliviates the need to comply with either of the two suggested solutions, and adds the convenience of being able to strike the match and light a cigarette without the need for removing the match-book from the strip.

The paper strip may have its two ends 8 gummed together with the appropriate material, after being wrapped tightly around the cigarette box.

The match-book may be closed by tucking its cover into a slot 9, as shown in FIG. 3, or by closing it in the usual way which is to insert the top flap behind the front piece 10, where usually a staple 11 secures the attachment of the match-book cover to the matches themselves.

I claim:

1. A cigarette pack-matches combination package that comprises of the common, and separable cigarette hard top box which is made of thin cardboard, or the soft cigarette pack which is made of paper and a separable common ordinary match book, where the match stems are parallel and are attached with a staple to a thin cardboard cover which is then bent over to completely cover the match stems and match heads, and a thin paper or cardboard strip that wrapps around the cigarette box or cigarette soft pack and the inner cover of the match book, with the end of the paper strip being then gummed together to hold tight both the cigarette box or cigarette soft pack and the match book which is then has its cover clipped on in place but with the paper strip still allowing the removal and insertion of the match book while the strip is in place, and where a spot of a geometrical shape of an abrasive material may be laid on the paper strip to give added striking surface for the matches.

* * * * *